US010465996B2

(12) United States Patent
Wintersteen et al.

(10) Patent No.: US 10,465,996 B2
(45) Date of Patent: Nov. 5, 2019

(54) METHOD OF MANUFACTURING A HEAT EXCHANGER ASSEMBLY HAVING A SHEET METAL DISTRIBUTOR/COLLECTOR TUBE

(71) Applicant: MAHLE International GmbH, Stuttgart (DE)

(72) Inventors: Douglas C. Wintersteen, Burt, NY (US); Donald R. Pautler, Lockport, NY (US); Bruce W. Dittly, North Tonawanda, NY (US); Neil A. Walkowski, Orchard Park, NY (US); Longhu Li, Williamsville, NY (US); Silas G. Goma, Amherst, NY (US)

(73) Assignee: MAHLE International GmbH, Stuttgart (DE)

( * ) Notice: Subject to any disclaimer, the term of this patent is extended or adjusted under 35 U.S.C. 154(b) by 185 days.

(21) Appl. No.: 14/735,561

(22) Filed: Jun. 10, 2015

(65) Prior Publication Data

US 2016/0363392 A1 Dec. 15, 2016

(51) Int. Cl.
*F28F 9/02* (2006.01)
*F28D 1/053* (2006.01)

(52) U.S. Cl.
CPC ..... *F28F 9/02* (2013.01); *F28D 1/05366* (2013.01); *F28F 9/0217* (2013.01)

(58) Field of Classification Search
CPC ..... F28F 9/0217; F28F 9/026; F28F 9/0214; F28F 9/028; F28F 9/02; F28F 2280/08;
(Continued)

(56) References Cited

U.S. PATENT DOCUMENTS 2,488,623 A * 11/1949 Goeltz ..... F28F 9/0278 138/38
5,586,600 A * 12/1996 Cribari ..... F28F 9/0212 165/173

(Continued)

FOREIGN PATENT DOCUMENTS

CA 2504759 A1 * 10/2006 ..... F16K 15/031
EP 1 884 733 A2 2/2008

(Continued)

*Primary Examiner* — Christopher R Zerphey
*Assistant Examiner* — Schyler S Sanks
(74) *Attorney, Agent, or Firm* — Brinks Gilson & Lione

(57) ABSTRACT

A heat exchanger assembly having a manifold, a partition member inserted into the interior cavity of the manifold through an open end such that the partition member cooperates with the interior surface of the manifold to partition the interior cavity into a manifold chamber and a distributor/collector chamber. The partition member and distributor/collector chamber function together as a distributor/collector tube within the manifold. The partition member includes a plurality of orifices along a length of the partition member, two opposite facing flange portions along the length of the partition member, a bulkhead panel extending from an end of the partition member adjacent the open end of the manifold, and a spring locator tab panel extending from an end of the partition member opposite of the bulk head panel, wherein the spring locator tab panel is biased against the closed end.

11 Claims, 5 Drawing Sheets

(58) Field of Classification Search
CPC ..... F28F 2280/105; F28D 1/05366; F28D 1/05316; Y10T 29/49361; Y10T 29/49368; Y10T 29/49938; Y10T 29/49936; Y10T 403/4916; Y10T 403/4924; Y10T 403/4933; Y10T 403/4949; Y10T 403/4966; F16B 21/08; F16B 21/086
USPC ..... 29/890.052
See application file for complete search history.

(56) References Cited

U.S. PATENT DOCUMENTS 6,269,868 B1 * 8/2001 Welding ..... B23K 1/0012 165/149
7,484,555 B2 * 2/2009 Beamer ..... F28D 1/05375 165/153
7,819,177 B2 * 10/2010 Beamer ..... F28D 1/05375 165/153
9,281,617 B2 * 3/2016 Reaves ..... H01R 13/639
2003/0116305 A1 * 6/2003 Beddome ..... F28D 9/0043 165/81
2006/0236718 A1 * 10/2006 Lundberg ..... F28D 1/05391 62/515
2011/0040263 A1 * 2/2011 Hordum ..... A61M 5/14248 604/272
2011/0277979 A1 * 11/2011 Masuda ..... F28F 9/0214 165/185
2013/0074340 A1 3/2013 Hirayama et al.

FOREIGN PATENT DOCUMENTS

JP 2005090946 A 4/2005
WO 2002/103263 A1 12/2002
WO 2015/027783 A1 3/2015

* cited by examiner

METHOD OF MANUFACTURING A HEAT EXCHANGER ASSEMBLY HAVING A SHEET METAL DISTRIBUTOR/COLLECTOR TUBE

TECHNICAL FIELD OF INVENTION

The present disclosure relates to a heat exchanger assembly; more particularly, to a heat exchanger assembly having a manifold containing a refrigerant distribution tube.

BACKGROUND OF INVENTION

A typical residential/commercial heat exchanger assembly used in a heat pump system, or otherwise known as a heat exchanger coil, includes an inlet manifold, an outlet manifold, and a plurality of refrigerant tubes hydraulically connecting the manifolds for refrigerant flow from one manifold to the other. Corrugated fins interconnect adjacent refrigerant tubes to increase the available heat transfer area, as well as to increase the structural integrity of the heat exchanger coil. The refrigerant tubes and interconnecting corrugated fins together define the core of the heat exchanger. A heat exchanger coil may function in evaporator mode or condenser mode, depending on the needs of the heat pump system.

For heat exchanger coils operating in evaporator mode, the effects of momentum and gravity on a refrigerant entering the inlet manifold can result in the premature separation of the refrigerant into liquid and gas phases in the inlet manifold, thereby causing poor refrigerant distribution through the bank of refrigerant tubes. Non-uniform refrigerant distribution through the refrigerant tubes degrades the heat transfer efficiency between the refrigerant and a stream of air passing through exterior of the core, resulting in uneven temperatures over the core of the heat exchanger coil.

To assist in providing uniform refrigerant distribution through the refrigerant tubes, it is known to utilize distribution tubes in the inlet and outlet manifolds for the distribution and collection of refrigerant, respectively. A distribution tube disposed within the inlet manifold for uniformly distributing a two-phase refrigerant throughout the length of the inlet manifold is known as a distributor. Similarly, a distribution tube disposed within the outlet manifold for uniformly collecting the vapor refrigerant exiting the outlet ends of the refrigerant tubes is known as a collector.

The inclusion of distribution tubes in the manifolds of heat exchanger coils are costly in terms of the materials and labor required for the manufacturing of the distribution tubes, the increase in mass of the heat exchanger coils, as well as the time and labor required for the assembling of the distribution tubes into the manifolds. Accordingly, there remains a continued need for heat exchanger coils having cost effective distribution tubes.

SUMMARY OF THE INVENTION

The invention relates to a heat exchanger assembly having a manifold, a partition member inserted into the interior cavity of the manifold through an open end such that the partition member partitions the interior cavity to define a manifold chamber and a distributor/collector chamber. The partition member and distributor/collector chamber functions together as a distributor/collector tube within the manifold. The manifold includes an endcap to seal the open end once the partition member is inserted and in position.

The partition member includes a plurality of orifices along a length of the partition member, two opposite facing flange portions along the length of the partition member, a bulkhead panel extending from an end of the partition member adjacent the open end of the manifold, and a spring locator tab panel extending from an end of the partition member opposite of the bulk head panel.

Once the partition member is inserted and positioned into the manifold, the spring locator tab panel is biased against the closed end of the manifold, the two opposite facing flanges and the edge surface of the bulkhead panels are abutted against the interior surface of the manifold. A protrusion may be provided in the interior surface to engage the bulkhead panel such that the partition member is held in position between the protrusion and closed end.

In the drawings as hereinafter described, a preferred embodiment is depicted; however, various other modifications and alternative designs and construction can be made thereto without departing from the spirit and scope of the invention.

BRIEF DESCRIPTION OF DRAWINGS

This invention will be further described with reference to the accompanying drawings in which.

DETAILED DESCRIPTION OF INVENTION

Figure 1:
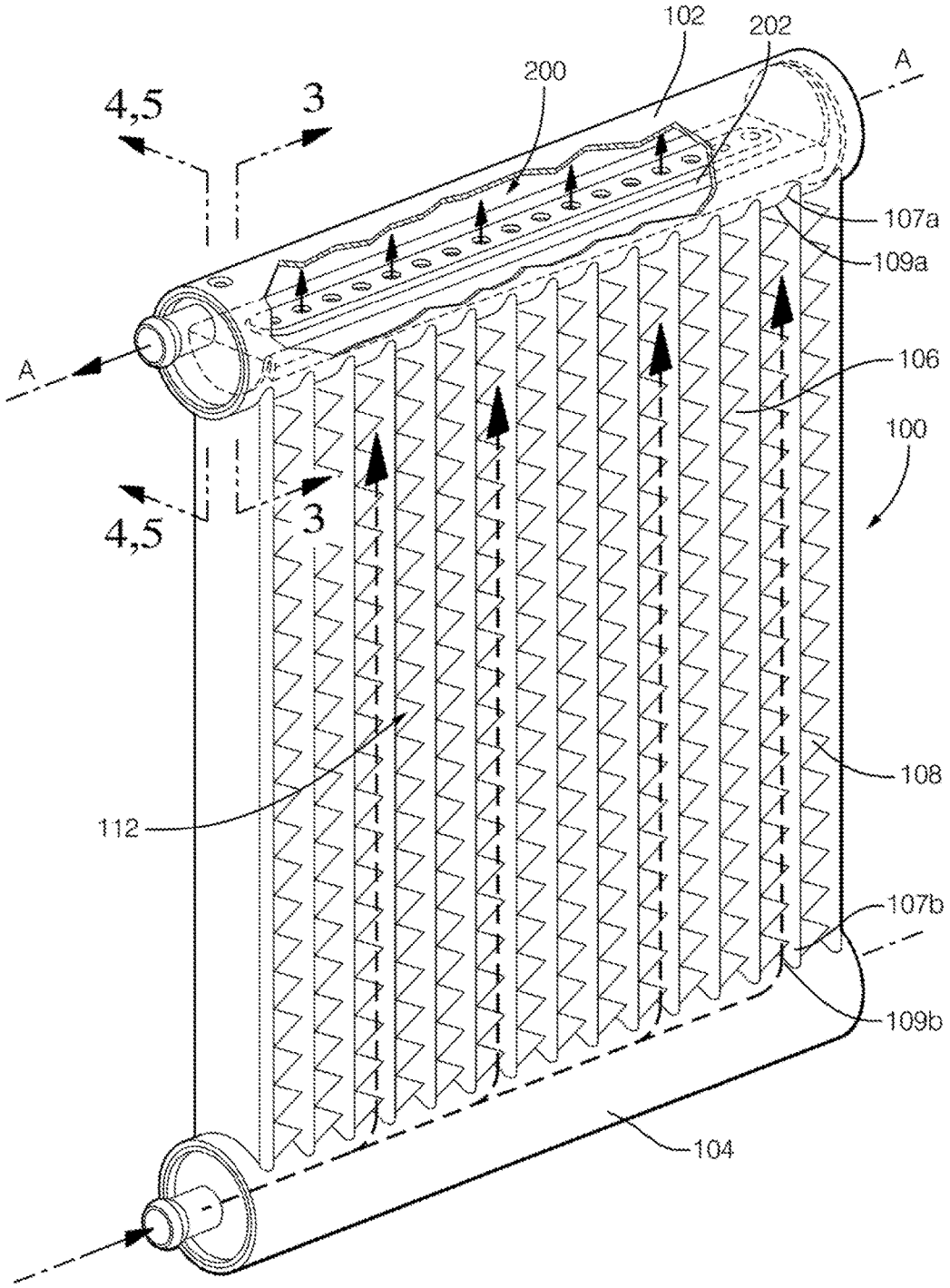
FIG. 1 shows a perspective partial cutaway view of a heat exchanger assembly having an improved distributor/collector tube of the current invention.

Distribution tubes are known to be used in heat exchanger assemblies to evenly distribute refrigerant flow across a bank of refrigerant tubes to provide uniform heat transfer across the cores of the heat exchanger assemblies. Distribution tubes used in the inlet manifold are known as inlet distributor tube and distribution tubes used in the outlet manifolds are known as outlet collector tubes. Shown in FIG. 1 is a perspective view of a heat exchanger assembly 100 having an improved refrigerant distribution tube 200. The improved distribution tube 200 is defined by a single piece folded manifold partition member 202 cooperating with the interior surface 204 of a manifold 102, 104. The improved distribution tube 200 may function as a distributor tube or a collector tube 200, depending on whether the heat exchanger assembly 100 is operating in condenser mode or evaporator mode, respectively; therefore the distribution tube 200 is also referred to herein as a distributor/collector tube 200.

Referring to FIG. 1, the heat exchanger assembly 100 includes a first manifold 102, a second manifold 104 spaced from the first manifold 102, and plurality of refrigerant tubes 106 hydraulically connecting the manifolds 102, 104. The refrigerant tubes 106 include opposite ends 107*a*, 107*b* that are inserted through corresponding tube slots 109*a*, 109*b* positioned along the length of each of the respective manifolds 102, 104. A plurality of fins 108 is disposed between and in contact with adjacent refrigerant tubes 106 to facilitate heat transfer between the refrigerant flowing within the refrigerant tubes 106 and a stream of ambient air flowing pass the exterior surfaces of the refrigerant tubes 106 and fins 108. The refrigerant tubes 106 together with the fins 108 define the core 112 of the heat exchanger assembly 100. The heat exchanger assembly 100 may be that of an evaporator type heat exchanger for an automobile or a heat exchanger coil capable of operating in evaporator mode.

For evaporator type heat exchangers and heat exchanger coils operating in evaporator mode, a bubbling gas/liquid phase refrigerant enters the lower manifold 104 and continues to flow through the bank of refrigerant tubes 106 to the upper manifold 102. As the refrigerant flows through the refrigerant tubes 106 absorbing heat energy from the stream of ambient air, the bubbling gas/liquid phase refrigerant changes into a gas phase. It is desirable for the refrigerant flow to be evenly distributed across the bank of refrigerant tubes 106 for uniform heat transfer across the core 112; therefore a collector tube 200 may be provided in the upper manifold 102 to enable even distribution of refrigerant flow across the bank of tubes. For exemplary purposes, the improved distributor/collector tube 200 shown represents a collector disposed in the outlet header 102 of an evaporator type heat exchanger or a heat exchanger coil operating in evaporator mode.

Figures 2, 3:
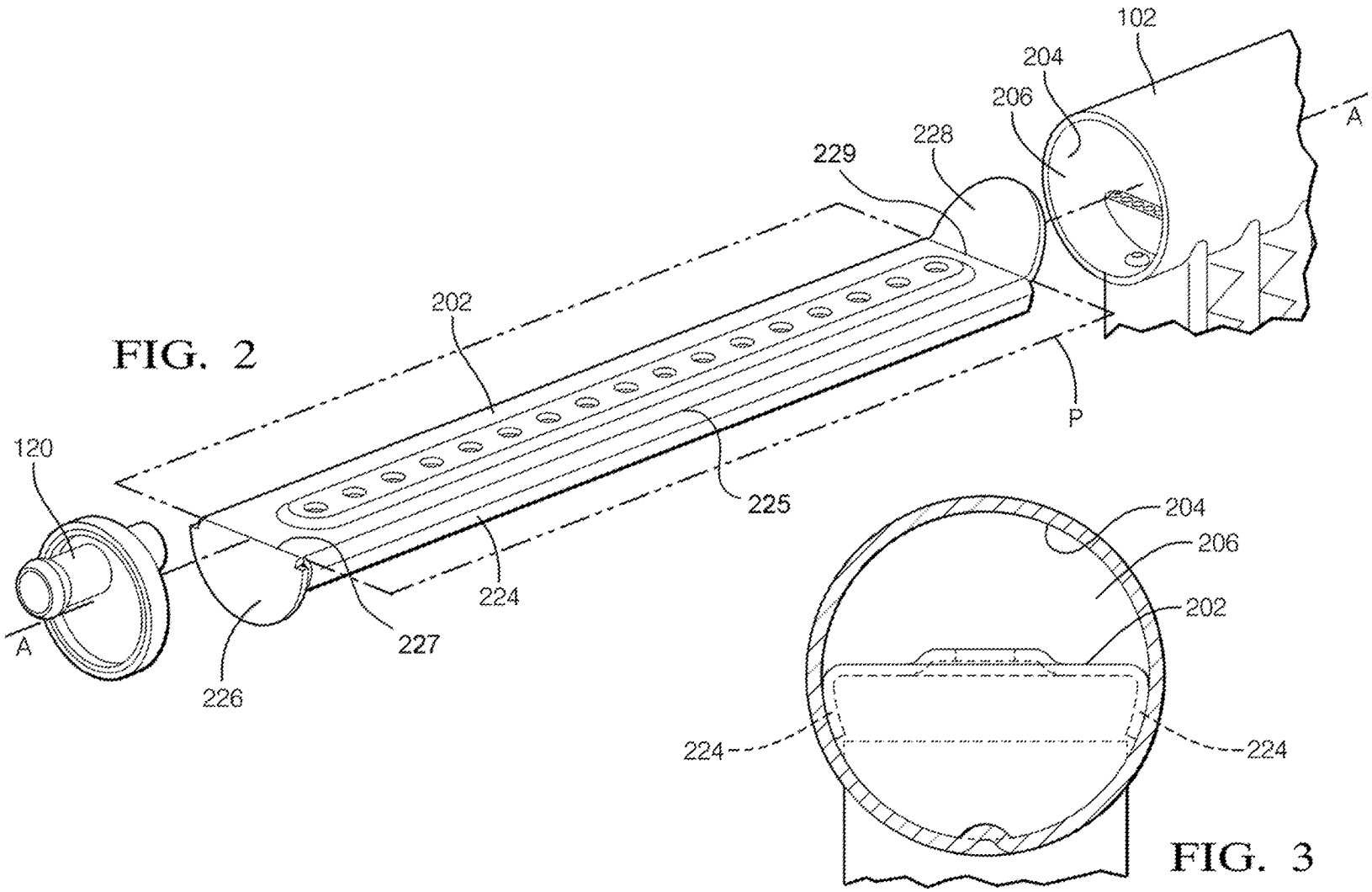
FIG. 2 shows a perspective view of a partition member prior to insertion into an open end of a manifold.
FIG. 3 shows the open end view of the manifold of FIG. 2 having the partition member inserted.
Figure 4:
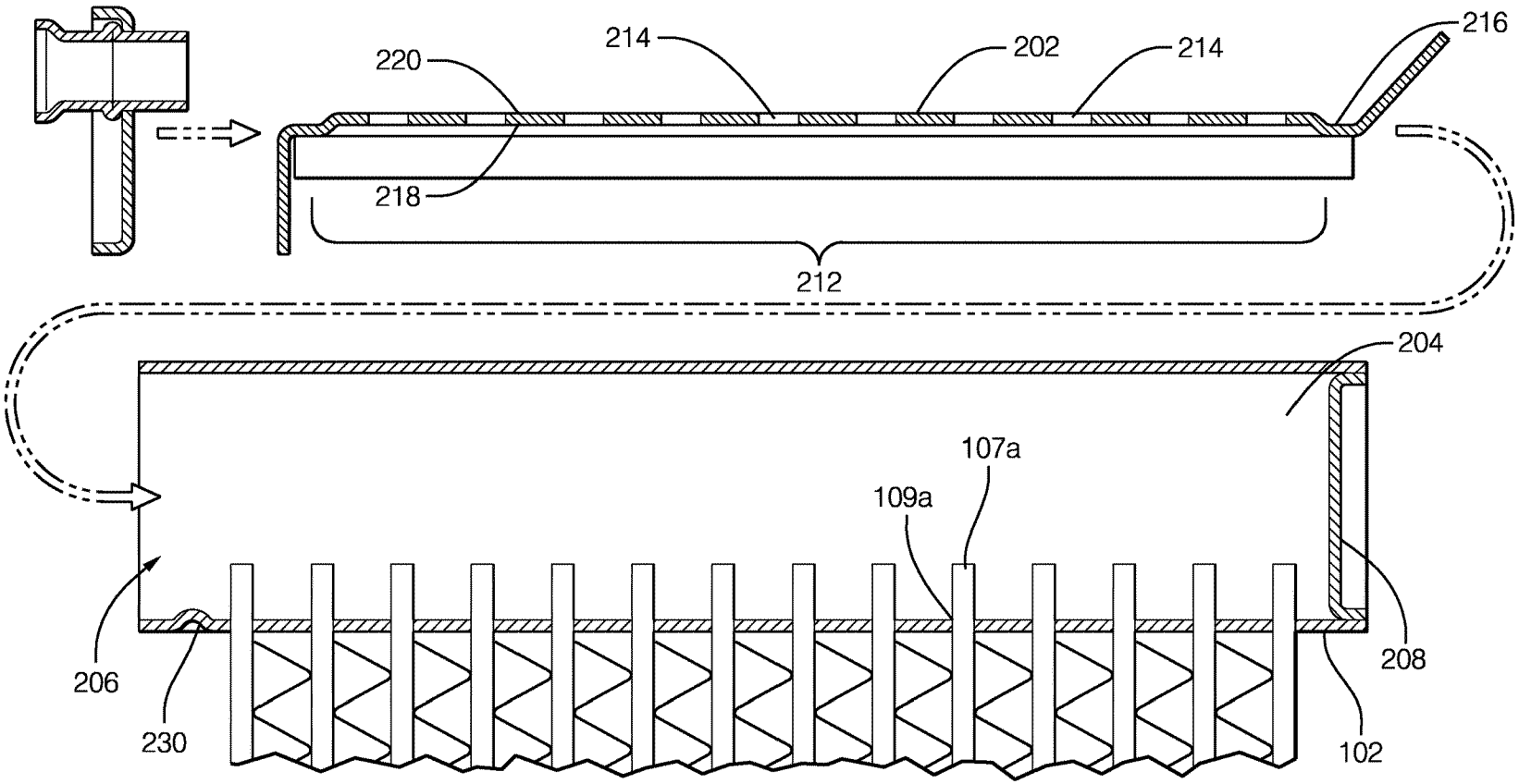
FIG. 4 shows a side view of the partition member being inserted into a cross section view of the open manifold through line 4-4.
Figure 5:
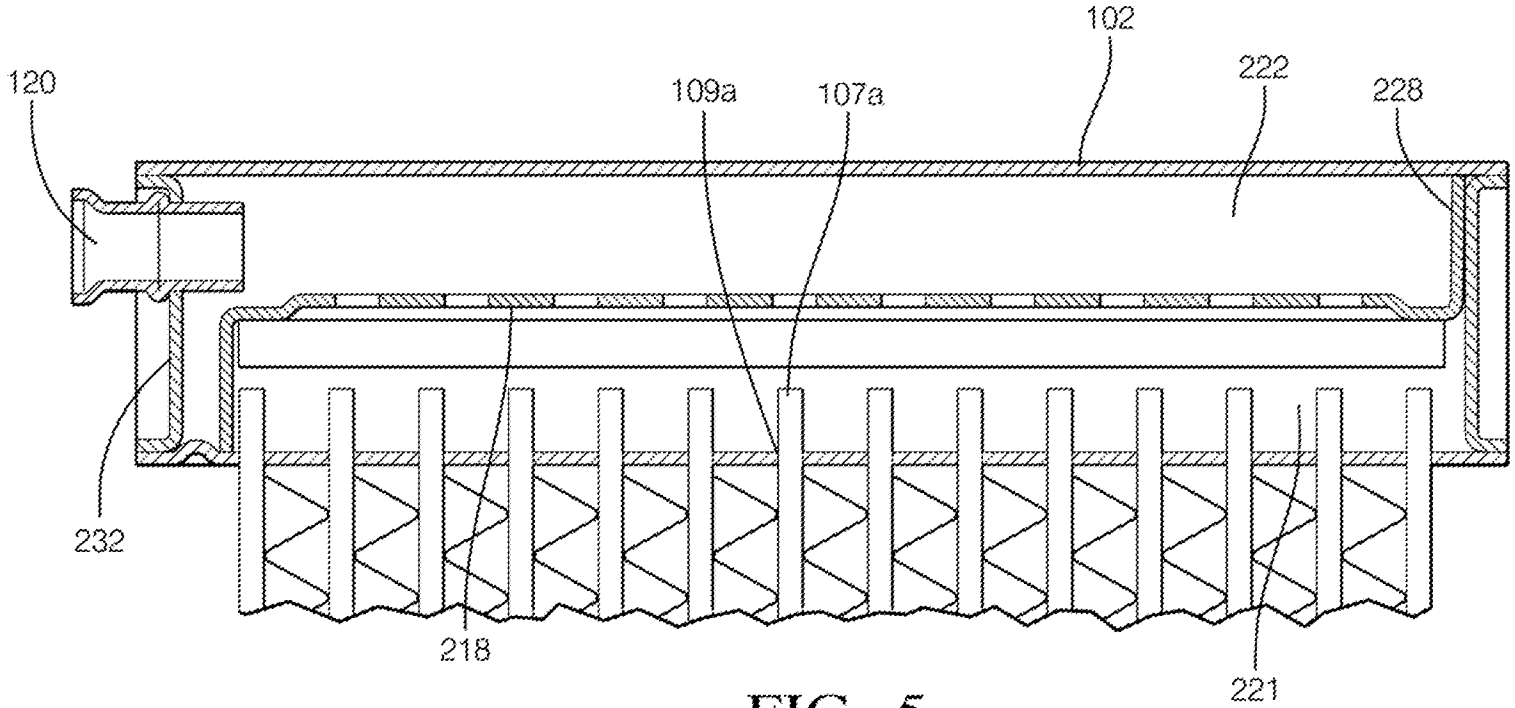
FIG. 5 shows a cross section view of the header of the heat exchanger assembly through line 5-5 having the partition member cooperating with the interior surface of the manifold to define an improved distributor/collector tube.
Figure 6:
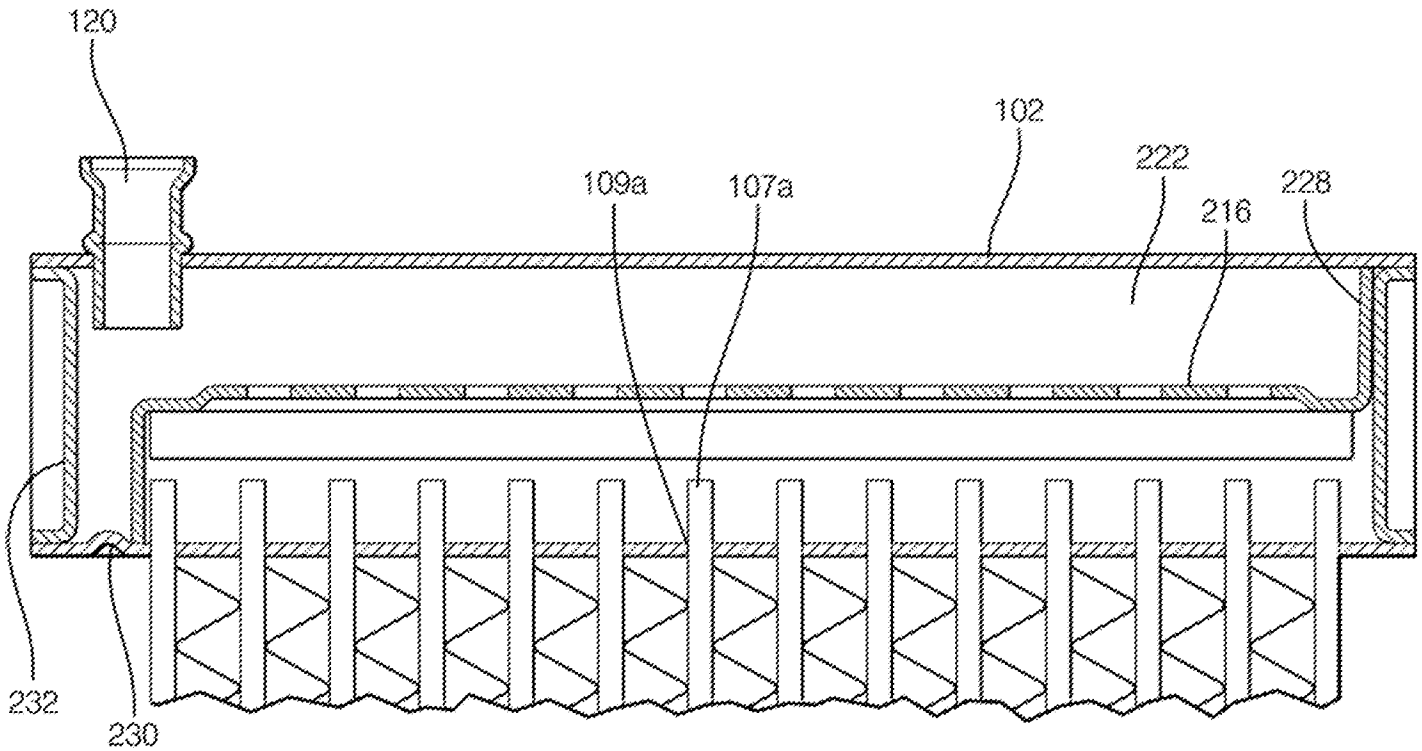
FIG. 6 shows a cross section of the header of the heat exchanger assembly having a refrigerant port on a side of the manifold.

Shown in FIG. 2 is a perspective view of the single piece manifold partition member 202 axially spaced from an opened end 206 of the upper manifold 102. Shown in FIG. 3 is an end view of the partition member 202 inserted into the manifold 102. The partition member 202 is configured to cooperate with the interior surface 204 of the manifold 102 to provide a distributor/collector tube 200 as shown in FIGS. 5 and 6. The partition member 202 includes a central portion 212 having a length and a width. A plurality of orifices 214 is defined along the length of the central portion 212. The spacing and size of the orifices 214 may be varied along the length of the central portion 212 to provide the restriction necessary to cause a desired back pressure gradient across the bank of refrigerant tubes 106 to provide an even distribution of refrigerant flow to achieve more uniform heat transfer across the face of the core 112. The central portion 212 may be substantially planar and includes a first surface 218 that is oriented toward the refrigerant tube slots 109*a* once the partition member 202 is inserted into the interior cavity and a second surface 220 that is oriented away from the tube slots 109*a*. The central portion 212 may also include a trough 216 running the length of the central portion 212, in which the depressed surface of the trough 216 is oriented toward the tube slots 109*a*. The plurality of orifices 214 may be defined along the length of the trough 216.

Best shown in FIGS. 2 and 3, the partition member 202 also includes a pair of opposite facing flanges 224 extending the length of the central portion 212. Extending from one end of the central portion 212 is a bulkhead panel 226 and extending from the opposite end is a spring locator tab panel 228. The bulkhead panel 226 is shown bent at a right angle with respect to the central portion 212 and the spring locator tab panel 228 is bent at an incline angle with respect to the central portion 212. The pair of opposite facing flanges 224 and the bulkhead panel 226 are configured to abut against the interior surface 204 of the manifold 102 once the partition member 202 is inserted and positioned within the manifold 102.

FIGS. 5 and 6 show alternative embodiments of the manifold 102, in which the partition member 202 enables the refrigerant port 120 to be located on the end cap or on a side of the manifold 102. Once the partition member 202 is inserted and positioned into the manifold 102, the spring locator tab panel 228 is biased against the closed end 208 of the manifold 102, the two opposite facing flanges 224 and the edge surface of the bulkhead panels are abutted against the interior surface 204 of the manifold 102. A protrusion 230 may be provided in the interior surface 204 to engage the bulkhead panel 226 such that the partition member 202 is held in position between the protrusion 230 and closed end 208. The biasing of the spring locator tab panel 228 against the closed end 208 allows for variances in tolerances between the length of the distribution partition member 202 and manifold 102 due to manufacturing tolerances.

The bulkhead panel 226 portion and central portion 212 cooperates with the interior surface 204 to partition the interior cavity into a manifold chamber 221 and distributor/collector chamber 222. The manifold chamber 221 is in direct hydraulic communication with the tube slots 109*a*and the distribution /collector chamber is in direct hydraulic communication with the refrigerant port 120. The orifices 214 provide direct hydraulic communication between the manifold chamber 221 and distribution/collector chamber 222.

In evaporative mode, the refrigerant tubes 106 convey a vapor refrigerant to the manifold chamber 220, the vapor refrigerant then flows through the orifices 214 of the partition member 202 into the distribution/collector chamber and then out the refrigerant port 120. The partition member 202 and distributor/collector chamber 222 functions together as a distributor/collector tube 200. The trough 216 and variable sized orifices 214 assist in the even collecting of refrigerant vapor from the manifold chamber 220, thereby assisting in providing uniform refrigerant flow through the tubes of the heat exchange assembly.

The partition member 202 may be formed from a thin sheet of metal that is amenable to brazing, such as a cladded aluminum sheet. The formed sheet may include a bulkhead panel 226 on one end, a spring locator tab panel 228 on the opposite end from the bulkhead panel 226, and two opposite flange panels 224 extending the length of the partition member 202. The panels may be folded along living hinges 227, 229, and 225 (see FIG. 2) or machine rolled to form the bulkhead panel 226, spring locator tab panel 228, and flanges 224, respectively, which extend integrally from the partition member 202. As an alternative, the partition member 202 may be stamped from a sheet of clad aluminum blank.

The manifolds 102, 104, refrigerant tubes 106, and fins 108 may be formed of a heat conductive material amenable to brazing, preferably an aluminum alloy. The refrigerant tubes 106 may be extruded from an aluminum alloy or formed by the folding of a sheet of aluminum alloy. The partition member 202 may be inserted into an open end of a manifold 102 and an end cap 232 is then used to close the open end. The refrigerant tubes 106 and fins 108 are assembled onto a stacker and the manifolds 102 are then assembled onto the assembled refrigerant tubes 106 and fins 108. The assembly is then brazed into an integral heat exchanger assembly 100. While an upper manifold 102 having the improved collector is shown, it is not intended to be so limiting. Those of ordinary skill in the art would recognize a distributor tube may be manufactured using the teaching of this disclosure for the manufacturing of a distributor tube 200.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having described the invention, it is claimed:

1. A heat exchanger assembly comprising;

a manifold having an open end, a closed end opposite of said open end, and an interior surface defining an interior cavity;

an end cap configured to seal the open end;

a partition member defining a plurality of orifices along a length of the partition member;

wherein the partition member is dimensioned to be inserted in the interior cavity through the open end such that the partition member abuts the interior surface and the closed end, thereby partitioning the interior cavity into a manifold chamber and a distributor or collector chamber, wherein the open end of the manifold is closed by an end cap so that the partition member is enclosed by the manifold between the closed end and the end cap;

wherein the partition member includes a central portion and a spring locator tab panel extending from an end of the central portion adjacent the closed end of the manifold, wherein the spring locator tab panel has a bent shape at a slope angle with respect to the central portion and, in an installed state of the heat exchanger assembly, is under tension and biased against the closed end such that the spring locator tab panel compensates for variances in length tolerances between the interior cavity of the manifold and the partition member.

2. The heat exchanger assembly of claim 1, wherein the partition member includes two opposite facing flange portions along the said length of the said partition member, wherein the said flange portions are configured to engage the said-interior surface.

3. The heat exchanger assembly of claim 1, wherein the partition member includes a bulkhead panel extending from an end of the central portion adjacent the open end of the manifold.

4. The heat exchanger assembly of claim 2, wherein the partition member includes a bulkhead panel extending from an end of the central portion adjacent the open end of the manifold.

5. The heat exchanger assembly of claim 3, wherein the interior surface includes a protrusion located between the open end and the bulkhead panel, wherein the protrusion is configured to engage the bulkhead panel to bias the spring locator tab panel against the closed end.

6. The heat exchanger assembly of claim 3, wherein:

the partition member includes a living hinge between the central portion and the bulkhead panel, and the bulkhead panel is folded at the living hinge at an angle approximately 90 degrees relative to the central portion.

7. The heat exchanger assembly of claim 6, wherein:

the partition member includes a living hinge between the central portion and the spring locator tab panel, and the slope angle is 45 degrees or greater relative to the central portion.

8. The heat exchanger assembly of claim 7, wherein the end cap includes a refrigerant port in direct hydraulic communication with the distributor or collector chamber.

9. The heat exchanger assembly of claim 7, where a side of the manifold includes a refrigerant port in direct hydraulic communication with the distributor or collector.

10. The heat exchanger assembly of claim 1, wherein the partition member includes a trough defining the plurality of orifices.

11. A heat exchanger assembly comprising;

a manifold having an open end, a closed end opposite of the open end, and an interior surface defining an interior cavity;

an end cap configured to seal the open end;

a partition member defining a plurality of orifices along a length of the partition member;

wherein the partition member is dimensioned to be inserted in the interior cavity through the open end such that the partition member abuts the interior surface and the closed end, thereby partitioning the interior cavity into a manifold chamber having tube slots for receiving ends of refrigerant tubes, and a distributor or collector chamber;

wherein the partition member includes a central portion and a spring locator tab panel extending from an end of the central portion adjacent the closed end of the manifold, wherein the spring locator tab panel has a bent shape with respect to the central portion and, in an installed state of the heat exchanger assembly, is under tension and biased against the closed end such that the spring locator tab panel compensates for variances in length tolerances between the interior cavity of the manifold and the partition member, wherein the central portion includes a planar portion surrounding a trough running along the central portion, the trough forming an indentation away from the tube slots such that a surface indented by the trough is oriented toward the tube slots.

* * * * *